US007681662B2

(12) United States Patent
Asakawa et al.

(10) Patent No.: US 7,681,662 B2
(45) Date of Patent: Mar. 23, 2010

(54) WATER BOTTOM ORE SAMPLER AND METHOD OF USING THE SAME

(75) Inventors: Yoshio Asakawa, Tokyo (JP); Ross E. Murray, Everett, WA (US); Freshteh Ahmadian, Reno, NV (US)

(73) Assignee: Williamson Deep Ocean Engineering, Inc., Seattle, WA (US)

( * ) Notice: Subject to any disclaimer, the term of this patent is extended or adjusted under 35 U.S.C. 154(b) by 91 days.

(21) Appl. No.: 12/040,146

(22) Filed: Feb. 29, 2008

(65) Prior Publication Data

US 2009/0218136 A1 Sep. 3, 2009

(51) Int. Cl.

| | |
|---|---|
| ***E21B 7/12*** | (2006.01) |
| ***E21B 49/00*** | (2006.01) |
| ***E21B 49/02*** | (2006.01) |
| ***G01N 1/04*** | (2006.01) |
| ***G01N 1/12*** | (2006.01) |

(52) U.S. Cl. ..... 175/20; 175/58; 73/864.41; 73/864.42; 73/864.43; 73/864.44; 73/864.45; 73/864.51

(58) Field of Classification Search ..... 175/59, 175/60; 166/99; 73/864.43
See application file for complete search history.

(56) References Cited

U.S. PATENT DOCUMENTS

| | | | | |
|---|---|---|---|---|
| 3,602,320 | A * | 8/1971 | Howard | 175/8 |
| 5,473,952 | A | 12/1995 | Lieberman et al. | |
| 5,559,295 | A * | 9/1996 | Sheryll | 73/864.63 |
| 7,225,877 | B2 | 6/2007 | Yater | |
| 7,325,628 | B2 | 2/2008 | Brunning et al. | |

* cited by examiner

*Primary Examiner*—Jennifer H Gay
*Assistant Examiner*—Catherine Loikith
(74) *Attorney, Agent, or Firm*—Richard A. Fagin

(57) ABSTRACT

A water bottom ore sampler includes a submersible housing for positioning on or near a water bottom, a riser duct mounted within the submersible housing and movable vertically relative to the submersible housing, a drilling assembly disposed within the riser duct for excavating the water bottom, a passage defined within the riser duct through which a particulate fluid mixture produced by the excavation can flow up the riser duct and into an interior of the submersible housing, and a sample container disposed within the submersible housing for collecting ore from the particulate fluid mixture received in the submersible housing.

10 Claims, 5 Drawing Sheets

WATER BOTTOM ORE SAMPLER AND METHOD OF USING THE SAME

BACKGROUND OF THE INVENTION

1. Field of the Invention

The invention relates generally to the field of water bottom deployed, remotely operated drilling and coring apparatus. More specifically, the invention relates to devices for taking large volume samples of sediments from below the bottom of a body of water.

2. Description of the Related Art

U.S. Patent Application Publication No. 2006/0016621 filed by Jackson et al. discloses a system for taking core samples below the bottom of a body of water. The system disclosed in the '621 publication includes a drilling platform positioned on the bottom of a body of water; a surface vessel; and a submersible robotic vehicle movable between the underwater drilling platform and surface vessel. The robotic vehicle performs one or more of the following underwater operations: (i) providing power to the underwater drilling platform; (ii) monitoring and/or controlling the operation of the underwater drilling platform; (iii) assembling drill rods to form a drill string; and (iv) recovering a core barrel from the drill string and transporting the core barrel to the surface. In one embodiment, the underwater drilling system includes a shuttle movable between the surface vessel and underwater drilling platform. The shuttle carries one or more of a tool, rod, and core barrel between the surface vessel and the drilling platform.

U.S. Pat. No. 3,670,830 issued to van der Widjen describes a drilling apparatus that is positioned on the ocean floor for cutting a borehole in the floor and removing samples therefrom. The drilling apparatus has a drilling head which is detachably coupled to a string of pipes all detachably connected together by connecting devices which are engageable by axial pushing of the pipes together. The pipes carry inner tubes which cooperatively form an inner annular cavity and a core member is detachably connected to the lowermost inner tube of the drill string by spring-loaded latches. When a core sample is in the core tube it is detached by fluid pressure in the space between the outer pipes and the inner tubes and the core barrel is then pumped upwardly and stored in a turntable containing further drill pipes and core barrels. A further drill pipe is connected in the string and a further core barrel is dropped into the inner tubes of the string and connected to the lowermost inner tube pressurizing fluid in the inner tubes.

The foregoing drilling and sample taking devices are generally configured to drill core samples from the sediments below the water bottom. Some types of water bottom sediments contain economically valuable minerals, such as heavy metals. The valuable minerals may be dispersed in the sediments below the water bottom, and determining the presence and concentration of such valuable minerals may require that large volumes of sediment are sampled if using the core drilling devices known in the art. There exists a need for a device that can sample large volumes of water bottom sediment, with the capacity to segregate the samples to reduce the volume of samples retrieved to the water surface for analysis.

SUMMARY OF THE INVENTION

In one aspect, the invention relates to a water bottom ore sampler which comprises a submersible housing for positioning on or near a water bottom, a riser duct mounted within the submersible housing and movable vertically relative to the submersible housing, a drilling assembly disposed within the riser duct for excavating the water bottom, a passage defined within the riser duct through which a particulate fluid mixture produced by the excavation can flow up the riser duct and into an interior of the submersible housing, and a sampler container disposed within the submersible housing for collecting ore from the particulate fluid mixture.

In yet another aspect, the invention relates to a method of sampling ore from a water bottom which comprises positioning a submersible housing having a vertically movable riser duct mounted therein at or near a water bottom, operating a drilling assembly mounted within the riser duct to excavate the water bottom, flowing a particulate fluid mixture produced by the excavation up a passage defined within the riser duct and into the submersible housing, and collecting ore from the particulate fluid mixture in a sample container disposed within the submersible housing.

Other features and advantages of the invention will be apparent from the following description and the appended claims.

DETAILED DESCRIPTION

Figure 1:
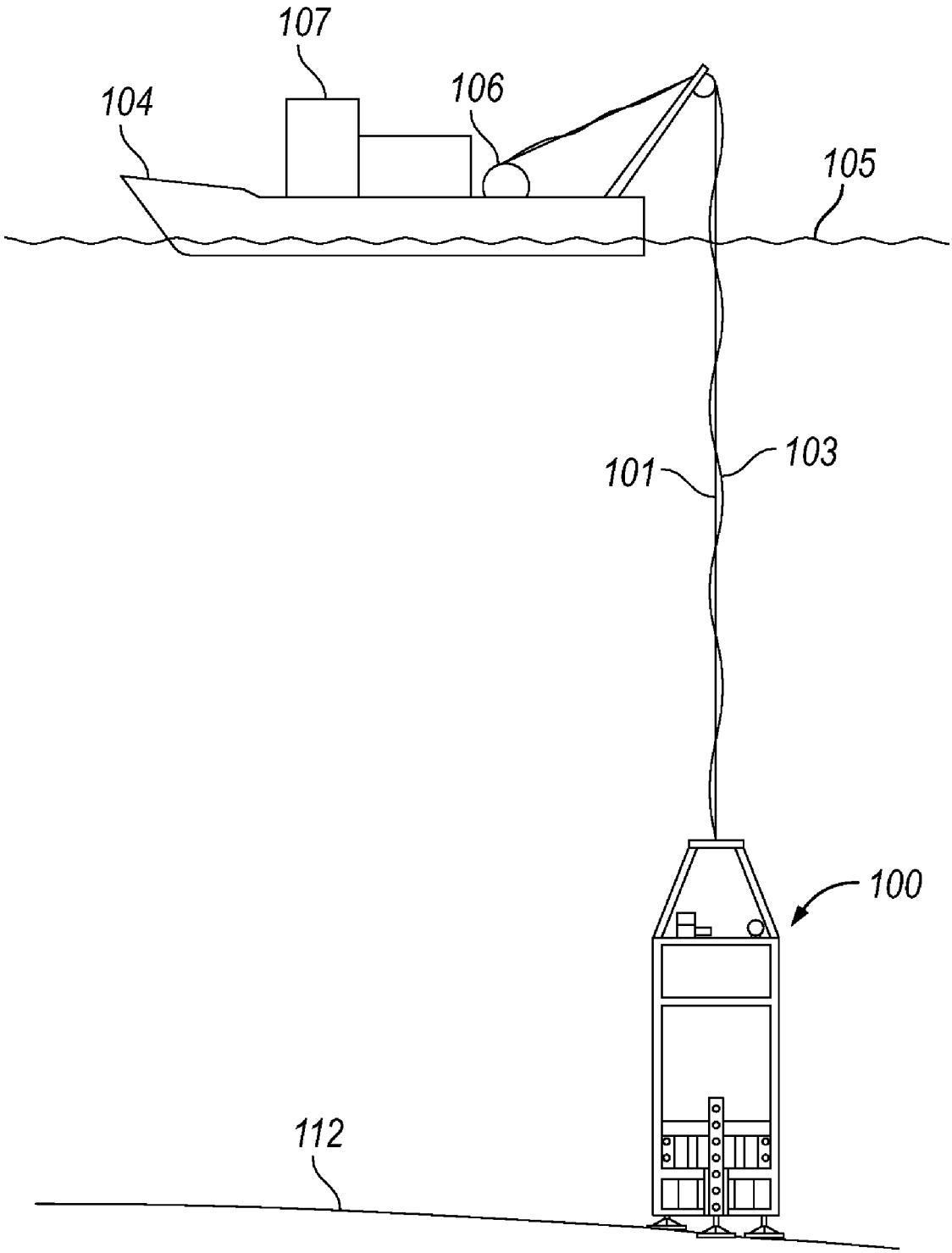
FIG. 1 is a schematic of an apparatus for collecting ore sample being deployed from a vessel.

The invention will now be described in detail with reference to a few specific examples, as illustrated in the accompanying drawings. In describing the specific examples, certain details are set forth in order to provide a thorough understanding of the invention. However, it will be apparent to one skilled in the art that the invention may be practiced without some or all of such details. In certain instances, well-known features and/or process steps have not been described in detail so as not to unnecessarily obscure the invention. In addition, like or identical reference numerals are used in the accompanying drawings to identify common or similar elements when they are shown in more than one drawing figure.

FIG. 1 shows an ore sampling apparatus 100 for collecting ore samples suspended by a cable 101. The cable can be extended and retracted by a winch device 106 or similar spooling device. The winch 106 may be disposed on a vessel 104 on or near a water surface 105. An electrical cable 103 extends from the vessel 104 to the apparatus 100 for providing electrical power to operate certain components of the apparatus 100 as needed. The vessel 104 may include a surface unit 107 for providing the electrical power and for providing remote control of the apparatus 100. The apparatus 100 as will be explained below is configured to be placed on the bottom 112 of the water.

Figure 2:
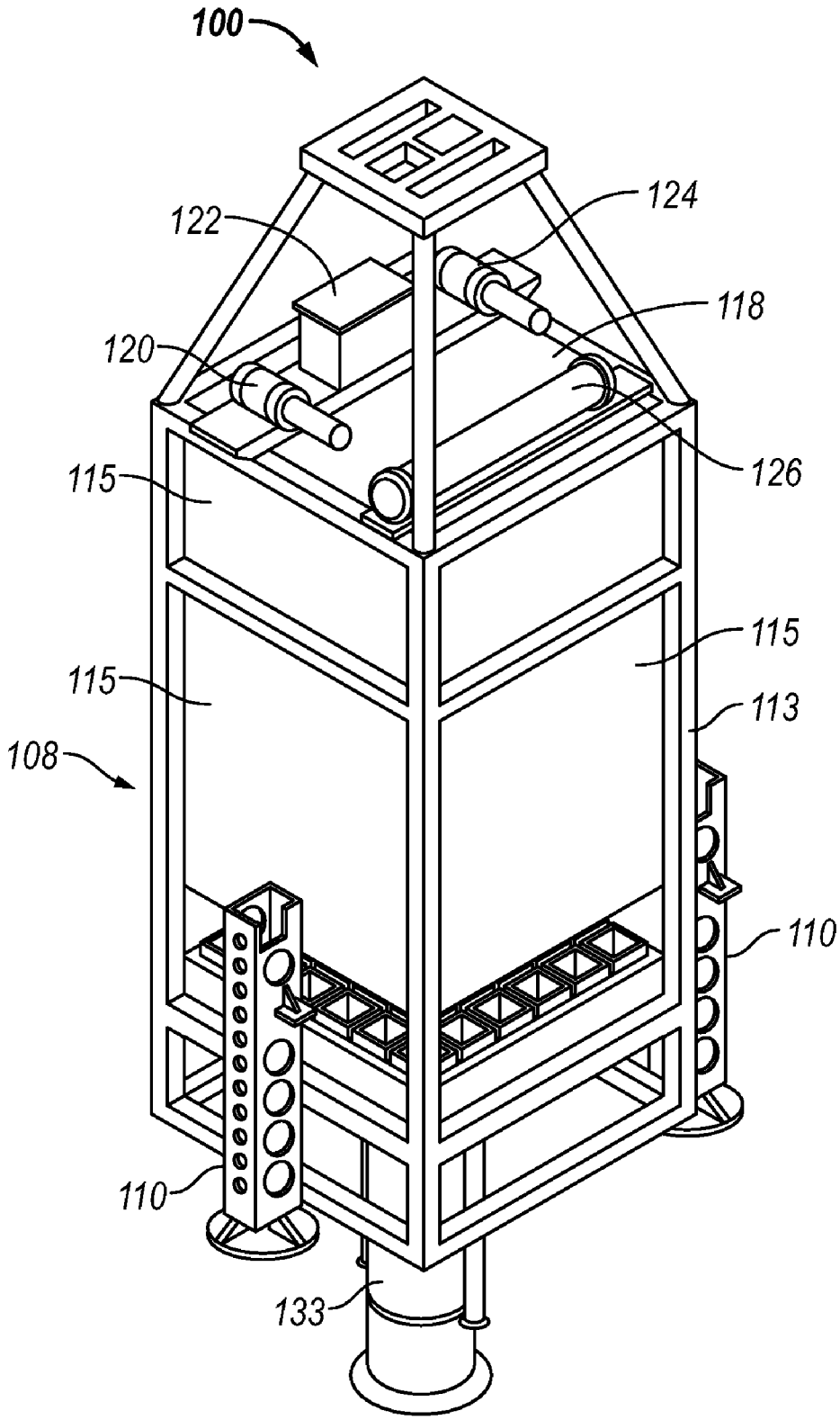
FIG. 2 is an enlarged, perspective view of the apparatus shown in FIG. 1.

As shown in more detail in FIG. 2, the apparatus 100 includes a submersible housing 108. Legs 110 are attached to the submersible housing 108 for positioning the submersible housing 108 near the water bottom (112 in FIG. 1). The submersible housing 108 may be in the form of a support frame 113, with panels 115 mounted in the support frame 113 to provide a barrier between the interior of the submersible housing 108 and the surrounding water. The panels 115 remain in place during operation and communication with the surrounding water is through openings 127 (in FIG. 3) above the panels 115.

Figure 3:
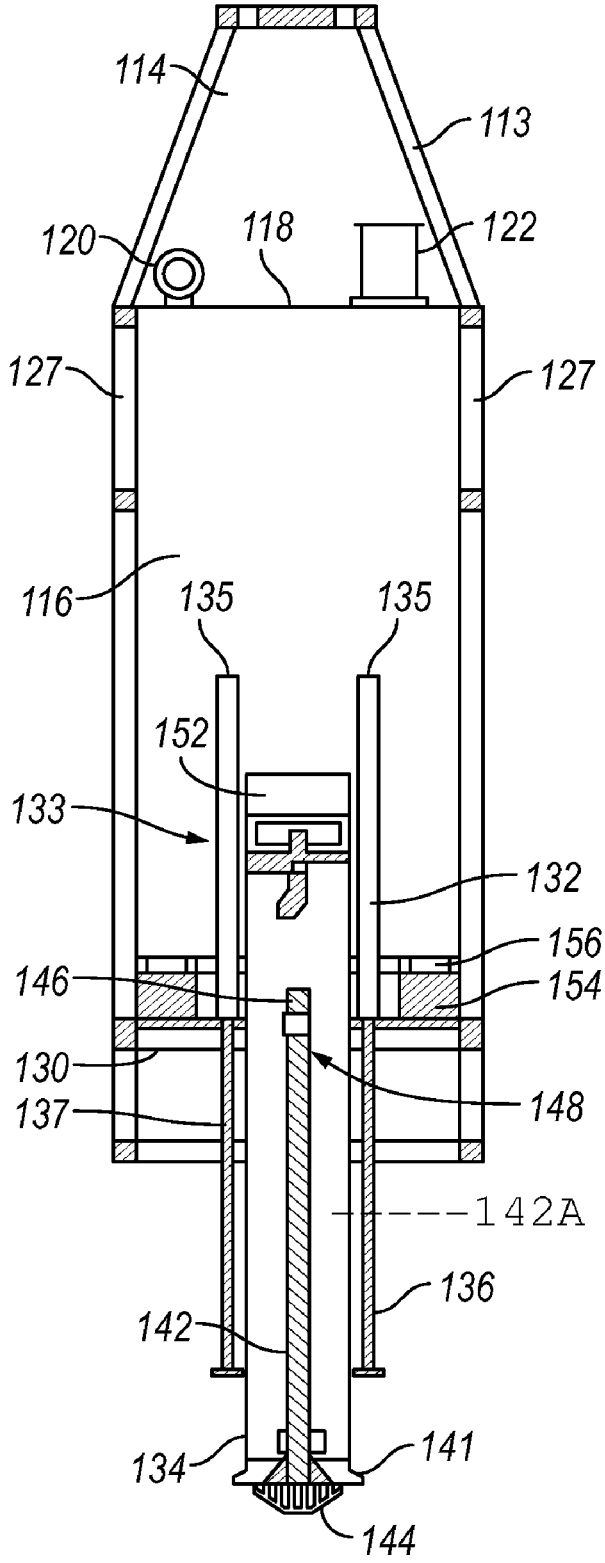
FIG. 3 is a vertical cross-section of the apparatus shown in FIG. 2.

Referring to FIG. 3, the support frame 113 includes a platform 118 which divides the submersible housing 108 into an upper chamber 114 and a lower chamber 116. Components such as a hydraulic pump 120, an electrical transformer 122, a flushing water pump (124 in FIG. 2), and telemetry power housing (126 in FIG. 2) can be mounted within the upper chamber 114.

The hydraulic pump 120 provides hydraulic pressure and fluid flow to operate devices such as an hydraulic cylinder (not shown) used to raise and lower a riser assembly 133 to facilitate retrieval after excavation of ore samples has been completed, and to apply downward pressure on the riser 133, if required, while excavating ore samples. The hydraulic pump 120 can also provide hydraulic pressure for leveling of the apparatus 100 by means of the hydraulic cylinders (not shown separately) on the extendable legs 110, and can provide rotational power to a drilling motor 146 and thruster 152 if hydraulic rather than electric motors are used for such purposes.

The openings 127 are provided in the submersible housing 108 for fluid communication between the lower chamber 116 and the exterior of the submersible housing 108. A plate 130 is mounted within the lower chamber 116, near the bottom of the submersible housing 108. One or more trays 154 are mounted on the plate 130. The trays 154 hold one or more sample containers 156 for collecting ore that settles within the lower chamber 116. The riser assembly 133 extends vertically through a central opening 132 in the plate 130. In FIGS. 2 and 3, the riser assembly 133 is shown as extending below the bottom of the submersible housing 108. In general, the riser assembly 133 is retracted within the submersible housing 108 when not collecting ore samples and is extended into the water bottom (112 in FIG. 1) when excavating the water bottom to collect ore samples. The riser assembly 133 includes a riser duct 134 that may be made from standard pipe sections and a diffuser 141. The riser duct 134 is arranged in the opening 132 to slide vertically within the opening 132 and relative to the submersible housing 108. Guide rails 136 are attached to the exterior of the riser duct 134 to guide vertical motion of the riser duct 134.

The lengths of the riser duct 134 and guide rails 136 can be determined by the desired excavation depth. The overall height of the apparatus 100 can be determined by this same requirement. The diameter of the riser duct 134 can likewise be selected or determined by the volume o(f) ore sample desired and will affect the horizontal dimensions of the apparatus 100 and the required power capacity of the thruster and drilling motor. The clearance between the top of the riser assembly 133 and the bottom of the platform 118, and the size of the openings 127 can be calculated and/or can be empirically selected to facilitate the flow and gravity separation of ore and sediment.

The guide rails 136 are received within guide slots 137 in the plate 130 and ride in the guide slots 137 when the riser duct 134 moves vertically. One or more hydraulic cylinders 135 may be provided to move the riser duct 134 vertically within the opening 132.

The hydraulic cylinder can be coupled to the main support frame 113, and the guide rails 136 can consist of two parts, one coupled to the riser assembly 133 and the other to the support frame 113 and bottom plate 130 of the apparatus 101. Alternatively, the riser duct 134 may simply be allowed to move within the opening 132 by gravity. The riser 133 is connected by means of the hydraulic cylinder directly to the support frame 113 and the guide rails 136 can be fitted with mechanical stops (not shown) at the limits of travel.

Figure 4:
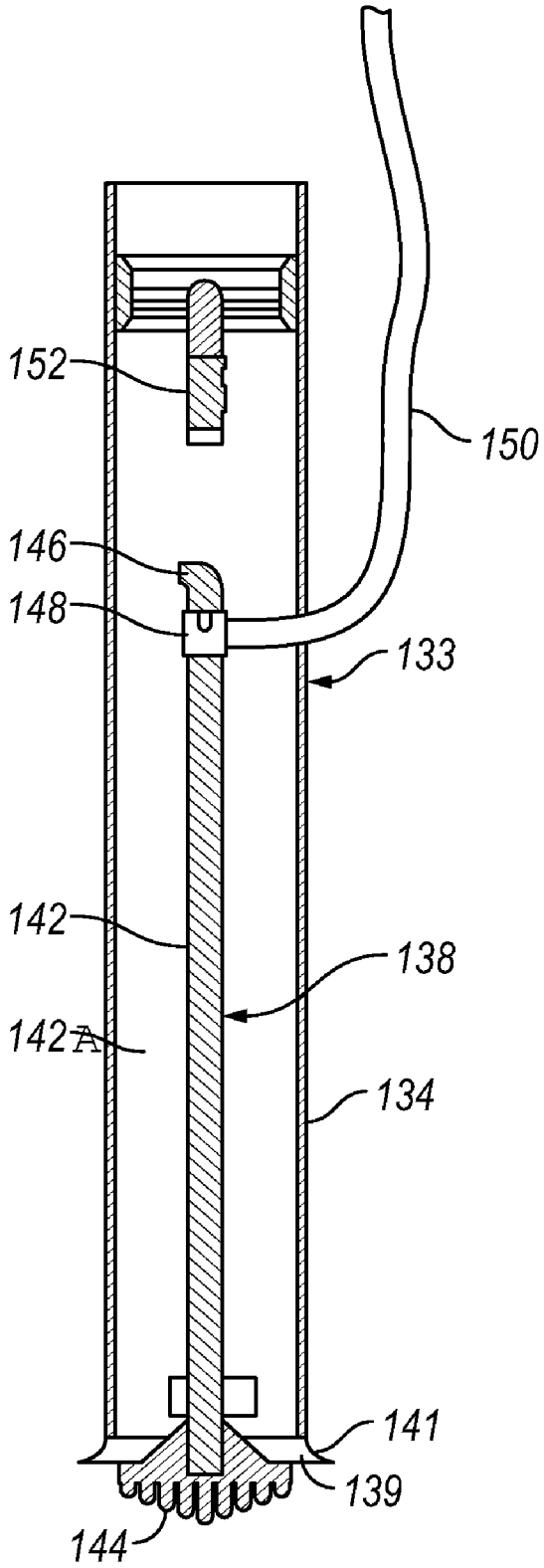
FIG. 4 is an enlarged view of the riser assembly shown in FIG. 3.

Referring to FIG. 4, a drilling assembly 138 is mounted inside the riser duct 134 with the longitudinal axis of the drilling assembly 138 generally aligned with the longitudinal axis of the riser duct 134.

A drill rod 142 can be fixed with respect to the riser duct 134 and supported by radial struts and bearings (not shown in the drawings). The same is true for the thruster, although some thruster designs can have an outer shroud containing field coils and can have an armature incorporated in a circular race in the shroud. Propeller blades can project inward from the outer circumference, therefore no central shaft is required. In this latter configuration the thruster shroud can be fixed to the inside wall of the riser duct.

The drilling assembly 138 includes the drill rod 142, which has a drill bit 144 attached at one end and the drill motor 146 attached at the other end. The drill bit 144 extends below the bottom end or diffuser 141 of the riser duct 134, leaving a gap 139 through which a particulate fluid mixture can enter the riser duct 134. The outer diameter of the portion of the drilling assembly 138 within the riser duct 134 is smaller than the inner diameter of the riser duct 134, leaving an annular space or passage 142A between the drilling assembly 138 and the riser duct 134. A particulate fluid mixture can flow up the riser duct 134 through such annular passage 142. The drill motor 146 receives power, typically either hydraulic or electric, from a hydraulic pump 120 or telemetry power housing (126 in FIG. 2) disposed in the upper chamber 114. The drill motor 146 drives the drill rod 142 and thus the drill bit 144. The drill rod 142 has a bore therein which is connected to receive fluid from the flushing water pump (124 in FIG. 2) through a water swivel 148 and hose 150. As the drill bit 144 excavates sediments on the water bottom 112, water is pumped down the bore of the drill rod 142 and through the drill bit 144 to carry away ore and sediments from the drill bit 144. The particulate fluid mixture (ore/sediment/water mixture) flows up the annular space 142A by reverse circulation. A thruster 152 is mounted at or near the top end of the riser duct 134 to assist with the reverse circulation by lowering the pressure at or near the top end of the riser duct 134 such that the pressure at or near the top of the riser duct 134 is lower than the pressure at or near the bottom end of the riser duct 134, thereby creating a pressure gradient which drives the particulate fluid mixture in the annular space 142A upwardly.

Figure 5:
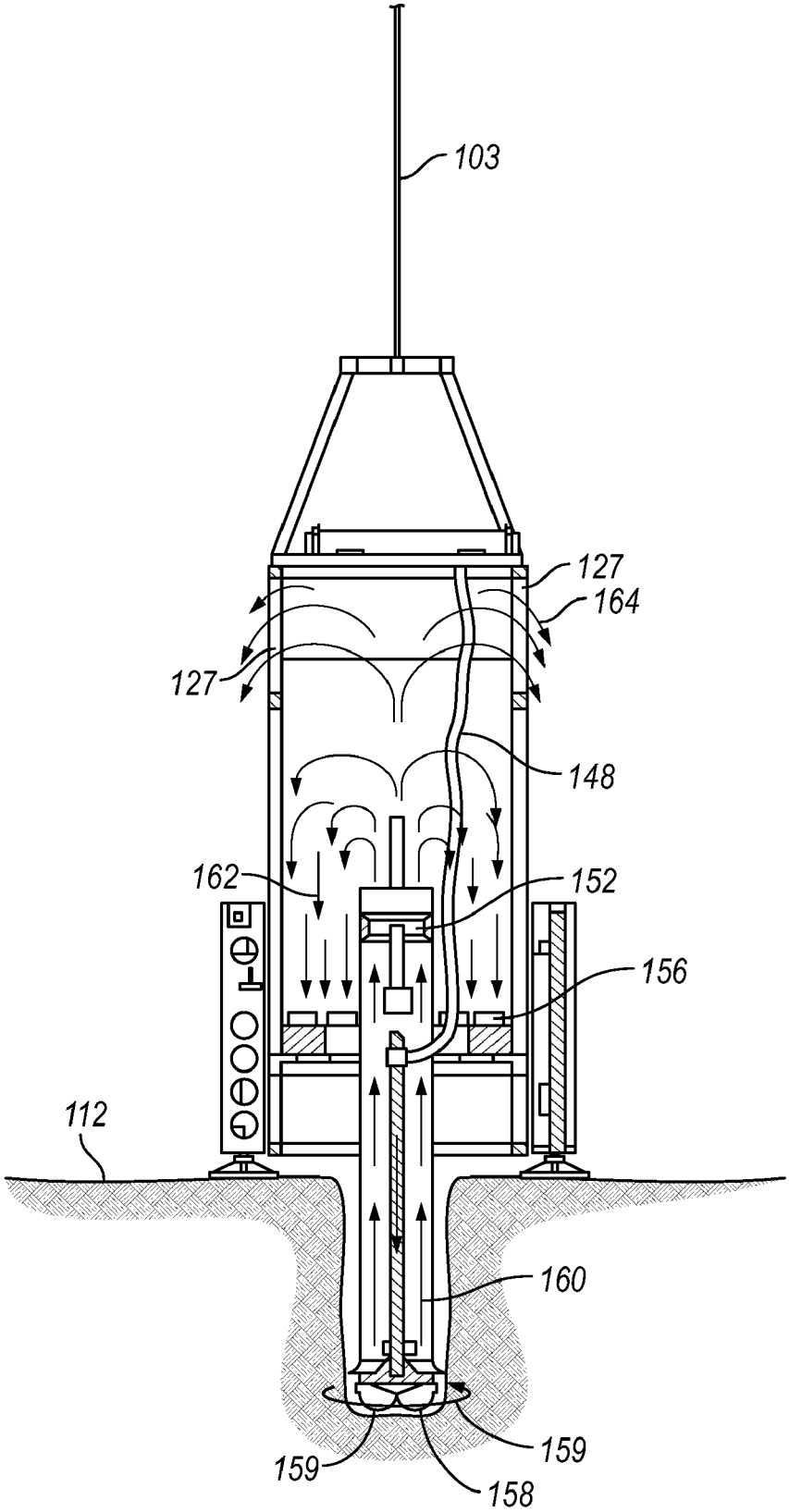
FIG. 5 illustrates a reverse circulation process for collecting ore using the apparatus shown in FIG. 1.

Referring now to FIG. 5, in operation, the drill bit 144 excavates the water bottom 112, creating a cavity 158 in the water bottom 112. As sediments and ore are excavated from the water bottom 112, the riser duct 134 extends into the cavity 158 by gravity and/or under power by extending a hydraulic cylinder (not shown). Simultaneously, particulate fluid mixture is formed at the drill bit 144 by the flushing water flowing down the drilling assembly 138 and the sediments and ore excavated by the drill bit 144. The particulate fluid mixture enters the riser duct 134 by reverse circulation, as indicated at 159, assisted by the thruster 152. The particulate fluid mixture flows up the annular space 142A defined in the riser duct 134, as indicated by arrows 160. The particulate fluid mixture flows out of the riser duct 134 into the lower chamber 116, as indicated by arrows 162, and out of the lower chamber 116 to the exterior of the submersible housing 108 through the openings 127, as indicated by arrows 164. As the particulate fluid mixture flows from the riser duct 134 to the openings 127, the velocity of the particulate fluid mixture decreases and differential settling of the heavier ore occurs within the lower chamber 116. The heavier ore concentrates within the lower chamber 116 and is collected in the sample containers 156. The lighter sediments flow out of the lower chamber 116 through the openings 127. The drill bit 144 may continue to excavate the water bottom 112 until the riser duct 134 is fully extended. The riser duct 134 may be subsequently retracted into the submersible housing 108 by a hydraulic cylinder or other similar device. After collecting the ore sample, the apparatus 100 can be raised from the water bottom 112 to the vessel (104 in FIG. 1) to allow recovery of the collected ore samples by operating the winch (106 in FIG. 1). Alternatively, the apparatus 100 may be moved to another location on the water bottom 112 to collect more ore samples.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A water bottom ore sampler, comprising:

a submersible housing for positioning on or near a water bottom;

a riser duct mounted within the submersible housing and movable vertically relative to the submersible housing;

a drilling assembly disposed within the riser duct and extensible from the housing for excavating sediments on the bottom of a body of water;

a passage defined within the riser duct through which a particulate fluid mixture produced by the excavation can flow up the riser duct and into an interior of the submersible housing; and a sample container disposed within the submersible housing for collecting ore from the particulate fluid mixture received in the submersible housing.

2. The water bottom ore sampler of claim 1, wherein the submersible housing includes an opening for fluid communication between the interior of the submersible housing and an exterior of the submersible housing.

3. The water bottom ore sampler of claim 1, wherein the drilling assembly comprises a drill bit extendable below a bottom end of the riser duct.

4. The water bottom ore sampler of claim 3, further comprising a thruster mounted proximate a top end of the riser duct and configured to reduce a pressure at the top end of the riser duct relative to a pressure at the bottom end of the riser duct.

5. The water bottom ore sampler of claim 3, further comprising a hydraulic pump mounted within the submersible housing.

6. The water bottom ore sampler of claim 5, wherein the drilling assembly further comprises a drill rod coupled to the drill bit and having a bore for receiving fluid from a flush fluid pump.

7. The water bottom ore sampler of claim 6, wherein the drilling assembly further comprises a motor for driving the drill bit.

8. A method of sampling ore from a water bottom, comprising:

positioning a submersible housing having a vertically movable riser duct mounted therein at or near a water bottom;

operating a drilling assembly mounted within the riser duct to excavate the water bottom;

flowing a particulate fluid mixture produced by the excavation up a passage defined within the riser duct and into the submersible housing; and collecting ore from the particulate fluid mixture in a sample container disposed within the submersible housing.

9. The method of claim 8, wherein operating the drilling assembly comprises pumping flushing fluid down a bore of the drilling assembly, wherein the fluid mixes with material excavated from the water bottom to form the particulate fluid mixture.

10. The method of claim 8, wherein flowing a particulate fluid mixture comprises lowering a pressure at a top end of the riser duct relative to the pressure at a bottom end of the riser duct.

* * * * *